US008146209B2

(12) United States Patent
Carnate

(10) Patent No.: US 8,146,209 B2
(45) Date of Patent: Apr. 3, 2012

(54) GLOVE HOLDER

(76) Inventor: Oliver C Carnate, Chicago, IL (US)

( * ) Notice: Subject to any disclaimer, the term of this patent is extended or adjusted under 35 U.S.C. 154(b) by 427 days.

(21) Appl. No.: 12/540,893

(22) Filed: Aug. 13, 2009

(65) Prior Publication Data

US 2011/0035911 A1 Feb. 17, 2011

(51) Int. Cl.
*A44B 6/00* (2006.01)
*A45C 1/06* (2006.01)
*G09F 3/20* (2006.01)

(52) U.S. Cl. ..... 24/3.1; 24/3.13; 150/148; 150/138; 40/661.07; 40/667; 40/661.04; 40/1.6; 206/37

(58) Field of Classification Search ..... None
See application file for complete search history.

(56) References Cited

U.S. PATENT DOCUMENTS 386,773 A * 7/1888 Diebel ..... 40/1.6
2,176,253 A * 10/1939 Fogarty ..... 40/661.06
2,521,037 A 9/1950 Brinton
3,214,852 A * 11/1965 Ford et al. ..... 40/640
3,446,260 A * 5/1969 Osher ..... 150/147
3,741,376 A * 6/1973 Brown et al. ..... 206/5
3,829,995 A * 8/1974 Fakoury ..... 40/649
4,829,691 A * 5/1989 Manjos et al. ..... 40/661
4,961,275 A * 10/1990 Klein ..... 40/1.5
4,964,508 A * 10/1990 Balsley ..... 206/37.1
4,984,683 A * 1/1991 Eller ..... 206/38
5,177,881 A * 1/1993 Moore ..... 34/239
5,384,972 A * 1/1995 Arnt ..... 40/1.6
5,715,215 A * 2/1998 Haas et al. ..... 368/327
5,864,925 A * 2/1999 McGee ..... 24/3.11
5,873,606 A * 2/1999 Haas et al. ..... 283/75
6,024,211 A * 2/2000 Johnston ..... 206/69
6,301,751 B1 * 10/2001 Ohlson ..... 24/3.11
6,339,866 B1 * 1/2002 French ..... 24/306
6,499,227 B1 12/2002 Jacobson
6,546,599 B2 4/2003 Pelt et al.
6,688,505 B1 2/2004 Bradlet et al.
6,752,305 B2 * 6/2004 Shattuck ..... 224/603
D532,606 S 11/2006 Ogonosky
7,322,068 B1 * 1/2008 Kim ..... 15/209.1
7,901,754 B2 * 3/2011 Nicastri ..... 428/99
2003/0218036 A1 11/2003 Collins
2008/0083803 A1 4/2008 Brantner et al.
2009/0217558 A1 * 9/2009 Maier-Hunke ..... 40/1.6

OTHER PUBLICATIONS

Glove Grabber advertisement found at http://www.amazon.com/gp/product/B000OV9TT8.

* cited by examiner

*Primary Examiner* — Jack W. Lavinder
(74) *Attorney, Agent, or Firm* — Miller Matthias & Hull LLP

(57) ABSTRACT

A holder for securing a glove or other article to a bag, hook or other item is provided. The holder comprises a ring, a snap hook type fastener attached to the ring in swivel fashion, and a rigid or semi-rigid tag suspended from the ring by a strap. In one embodiment the tag comprises two members or halves hingedly connected to each other in clamshell fashion so that the two members can be folded together and held together via hook and loop type fasteners. The glove may be secured to the holder via hook and loop type fastening surface located on the glove. The holder can also secure an article not having a hook or loop type fastening surface by draping the article over the hinge.

4 Claims, 11 Drawing Sheets

First Embodiment

Second Embodiment

Second Embodiment

Second Embodiment

Second Embodiment

Second Embodiment

Third Embodiment

Third Embodiment

Third Embodiment

Third Embodiment

Fourth Embodiment

GLOVE HOLDER

BACKGROUND

1. Field of the Invention

This invention relates to a device to secure articles to a bag, hook, item of clothing or other item. More particularly, this invention relates to a holder having a hook or loop type fastening surface for retaining articles, and a snap-hook type fastener for securing the holder to a golf bag or other item.

2. Description of the Related Art

Numerous means for holding gloves and other articles to a golf bag or other item are known. For example, U.S. Pat. No. 5,177,881 discloses a device that holds a golf glove using Velcro® type (hook and loop type) fasteners. Two straps are attached to either side of a decorative plate-like element, with one strap holding the glove via hook and loop type fasteners and the other strap attached to the golf bag via a hook type fastener. The device can be hung from a golf bag.

U.S. Pat. No. 5,864,925 discloses a device that holds a golf glove to a belt or other item using a plastic card having a patch of hook and loop type fasteners. The glove is attached to the patch of hook and loop fasteners, and the card is suspended from a belt via a metal clip.

U.S. Pat. No. 6,546,599 discloses a device for carrying a golf glove from a back pocket. The device is a foldable rectangular panel having a surface partially covered with hook and loop type fastening material. The panel can be folded and one half inserted into the back pocket of the user while the part covered with hook and loop type fastening material hangs outside the back pocket. Magnets may be used to secure the half of the panel inside the pocket to the half outside the pocket.

U.S. Pat. No. 6,694,575 discloses a flat, rectangular sports holder that attaches to a belt. The holder includes a patch of facing hook and loop type fastening material for securing the glove to the holder and slits threw which the belt is threaded.

While each of these inventions may be suitable for its intended purpose, none of these inventions provides a holder having two rigid halves hingedly attached by a connecting strap such that the holder can be folded and unfolded to hold not only items having a hook and loop type fastening surface, but also items having straps or other means for draping the item over the connecting strap. It is an object of the present invention to provide a holder having these features. Another object of the present invention is to provide a device that can hold a glove or other item and is easy to use and attractive in appearance. Further and additional objects will appear from the description, accompanying drawings, and appended claims.

SUMMARY OF THE INVENTION

The present invention is a holder for holding a glove or other article to a bag, hook, item of clothing or other item, wherein the glove or other article includes a surface having hook or loop type fastening material. The holder comprises a D-shaped ring, a snap-hook type fastener attached to the ring in swivel fashion, and a rigid or semi-rigid hang tag connected to the ring by a strap. The hang tag has a surface made of hook or loop type fastening material which can be used to hold the glove or other article.

In a first embodiment the hang tag comprises an attachment panel substantially coextensive with and attached to a decorative panel. The attachment panel has hook or loop type fasteners disposed on its outer facing side and the decorative panel has a decorative element disposed on its outer facing side. The hang tag may also comprise an inner web of stiffening material interposed between the attachment panel and the decorative panel to impart rigidity to the hang tag. The attachment and decorative panels may be attached to the inner web via adhesive or attached to each other.

In a second embodiment of the invention the tag comprises first and second members hingedly attached to each other via a flexible connecting strap so the tag can open and close in clamshell fashion. The first member comprises an attachment panel having a hook type fastening material disposed on one side and a decorative panel co-extensive with and secured to the other side of the attachment panel. The second member also comprises an attachment panel having a loop type fastening material disposed on one side and a decorative panel co-extensive with and secured to the other side of the attachment panel. The two members may be moved from a closed position in which the two members are folded and held together via the hook and loop type fastening material to an open position wherein the two halves are unfolded and held together only by the flexible connecting strap. The glove or other article may be secured to one or both of the first and second members via a hook and loop type fastening system. An inner web of stiffening material may be interposed between the attachment and decorative panels of each member.

Third and fourth embodiments of the invention are anticipated that are similar to the second and first embodiments respectively, except that the decorative panels are removable.

THE DRAWINGS

DETAILED DESCRIPTION OF THE INVENTION

Figure 1:
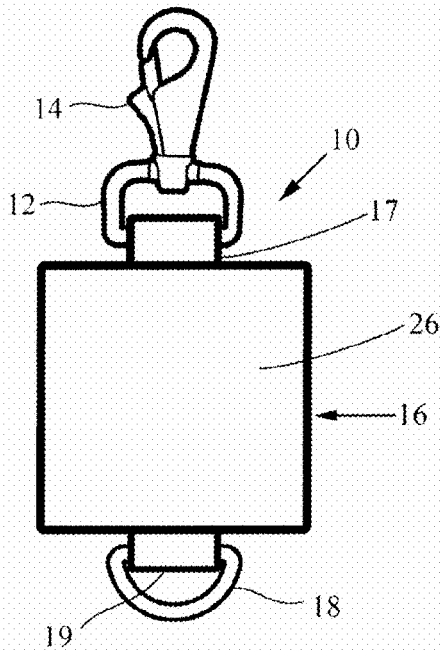
FIG. 1 is a front plan view of a holder according to the present invention.
Figure 2:
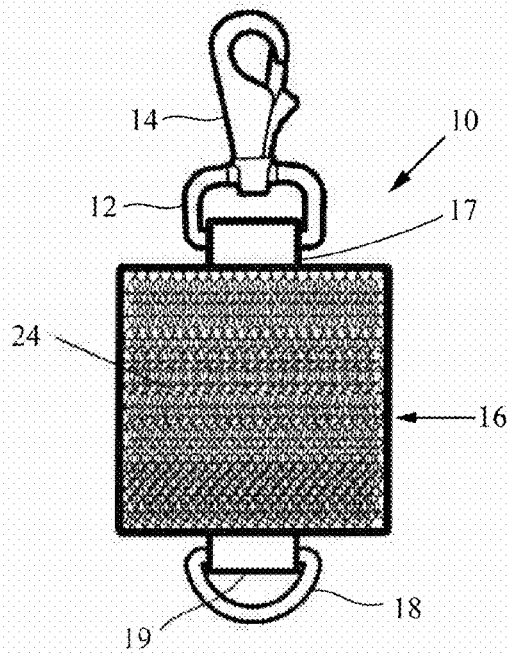
FIG. 2 is a rear plan view of the holder of FIG. 1.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

The invention is a holder for holding a glove or other article to a bag, hook, item of clothing or other item, wherein the glove or other article includes a surface having hook or loop type fastening material. The present invention can be used to secure article in a place where they can be readily accessed, such as a golf bag or belt loop. The holder of the present invention also allows articles such as gloves, handbags and shoes to be secured in a place where they are exposed to the air for drying or other purposes.

First Embodiment: One Attachment Panel

Turning to the drawings, there is shown in FIGS. 1 to 4 one embodiment of the present invention, a holder 10 that can be used to secure gloves or other small articles to a bag or to any other desired item or place. In this first embodiment, the holder 10 comprises a metal or plastic D-shaped ring 12, a snap-hook type fastener 14 attached to the ring 12 in swivel fashion, and a hang tag 16 for attaching a glove (not shown) or other article to the ring 12.

The hang tag 16 is attached to the ring 12 by a flexible strap 17. Preferably the flexible strap 17 is a loop of material that is looped around the straight section of the D-shaped ring 12 with both ends sewn into or otherwise secured to the hang tag 16. A second ring 18 may be secured to the lower edge of the hang tag 16 by a flexible loop 19.

Figure 3:
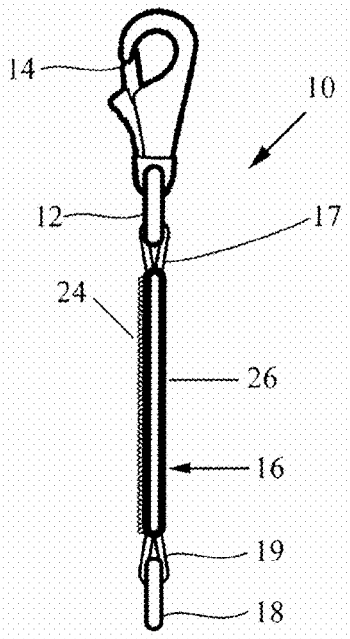
FIG. 3 is a side view of the holder of FIG. 1 with the snap hook shown rotated ninety degrees.
Figure 4:
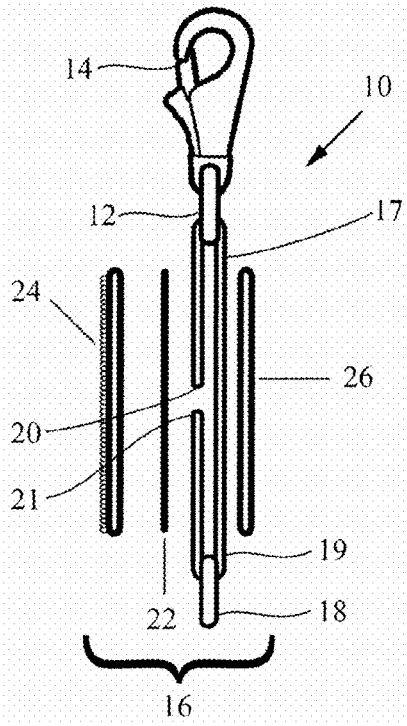
FIG. 4 is an exploded view of the holder of FIG. 3.

FIG. 4 is an exploded view of the holder 10 of FIG. 3. In this view the construction of the hang tag 16 can best be seen. The hang tag 16 comprises an inner layer 22 of stiffening material interposed between an attachment panel 24 and a decorative panel 26. The attachment panel 24 comprises hook or loop type fastening material disposed on an outer facing side, i.e., the side of the attachment panel 24 facing away from the decorative panel 26. The decorative panel 26 may have a decorative element disposed on its outer facing side. The attachment and decorative panels 24, 26 may be attached to the inner layer 22 with adhesive or other means, or may be attached to each other.

Still referring to FIG. 4, the flexible strap 17 and flexible loop 19 may be formed from a single integral strap of flexible material (such as nylon). The single strap has a first end 20 secured between the attachment panel 24 and the decorative panel 26, a first section extending from the first end 20 and looped around the straight section of the D-shaped ring 12 to form the flexible strap 17, a second section extending from the flexible strap 17 between the attachment panel 24 and the decorative panel 26, a third section extending beyond the hang tag 16 to form the flexible loop 19, and a second end 21 secured between the attachment panel 24 and the decorative panel 26.

To use the holder 10, the glove or other article must have a surface having hook or loop type fasteners to affix to the attachment panel 24. The glove (or other article) attachment surface is simply pressed against the fastening material on the attachment panel 24 and secured thereto. The holder 10 itself can be secured to a golf bag or other item by using the snap hook fastener 14, preferably with the decorative panel 26 facing outward.

If desired, another article (not shown) can be attached to the second rind 18.

Second Embodiment: Clamshell With Two Attachment Panels

Figure 5:
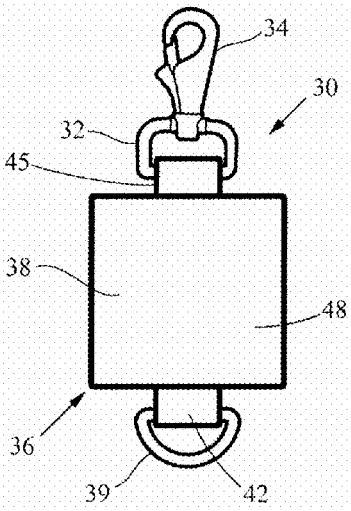
FIG. 5 is a front plan view of a second embodiment of a holder according to the present invention, shown in the folded position.

FIG. 5 is a front plan view of a second embodiment of a holder 30 according to the present invention, shown in the folded position. In this second ("clamshell") embodiment the holder 30 comprises a metal or plastic D-shaped ring 32, a snap hook type fastener 34 attached to the ring 32 in swivel fashion, and a clamshell tag 36 for attaching a glove (not shown in FIG. 5) or other article or articles to the ring 32.

The clamshell tag 36 is attached to the ring 32 by a flexible strap 37. As in the first embodiment, the flexible strap 37 may be a loop of material that is looped around the straight section of the D-shaped ring 32 with both ends sewn into or otherwise secured to the clamshell tag 36 or, more particularly, to one half of the clamshell tag 36.

Figure 6:
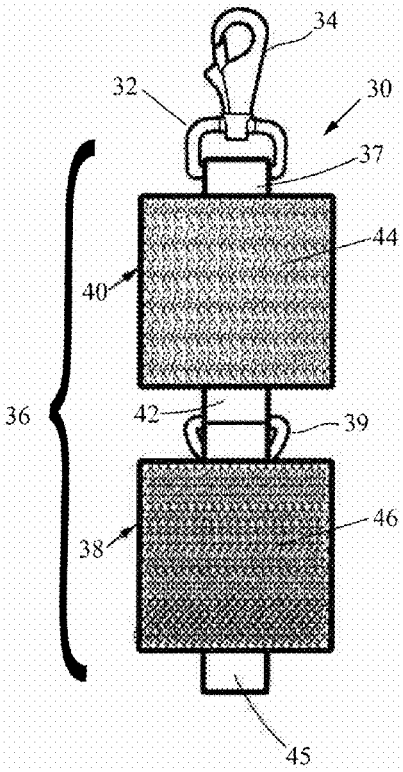
FIG. 6 is a front plan view of the holder of FIG. 5 shown in the unfolded position.
Figure 7:
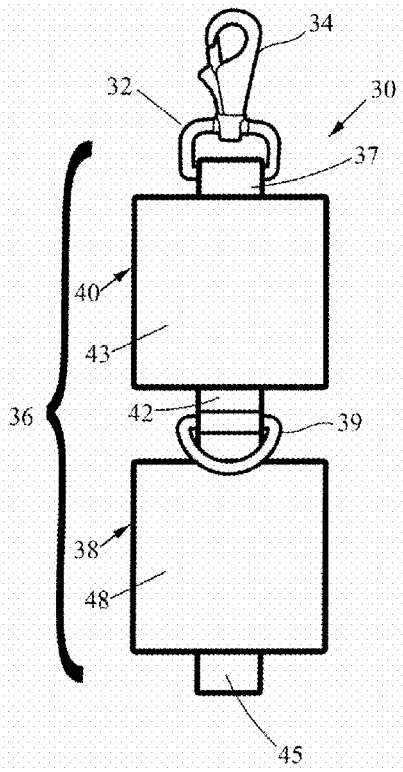
FIG. 7 is a rear plan view of the holder of FIG. 6 shown with the snap hook rotated 180 degrees.

FIGS. 6 and 7 are front and rear plan views respectively of the holder 30 of FIG. 5, shown in the unfolded position. In these views it can be seen that the clamshell tag 36 comprises lower and upper halves or members 38, 40 hingedly attached to each other via a flexible hinge strap 42. The hinge strap 42 is sewn into or otherwise attached to each half 38, 40 of the clamshell tag 36. An optional second ring 39 may be secured to the hinge strap 42.

Figure 9:
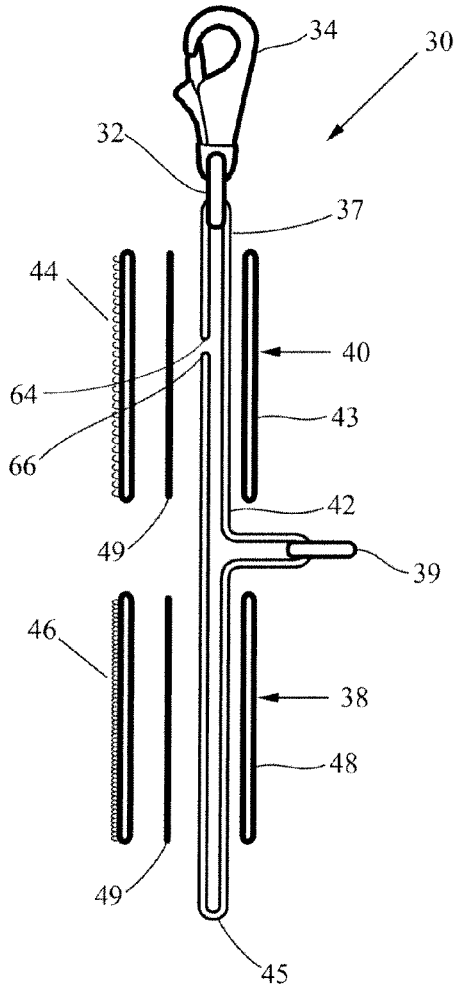
FIG. 9 is an exploded view of the holder of FIG. 8, shown in the unfolded position.

As best shown in FIG. 9, the lower member 38 (i.e., the member disposed away from the snap-hook type fastener 34) comprises an inner layer of stiffening material 49 interposed between a first attachment panel 46 and a first decorative panel 48. The first attachment panel 46 comprises a layer of hook or loop type fastening material disposed on an inner facing side (the side facing the upper member 40 when the holder 30 is in the folded position). The decorative panel 48 preferably has a decorative element disposed on its outer facing side. A pull tab 45 may be affixed to the perimeter of the lower member 38 away from the hinge strap 42.

The upper member 40 (closest to the snap-hook type fastener 34) comprises an inner layer of stiffening material 49 interposed between a second attachment panel 44 having hook or loop type fastening material disposed on an inner facing side and a second decorative panel 43 preferably having a decorative element disposed on an outer facing side.

Figure 8:
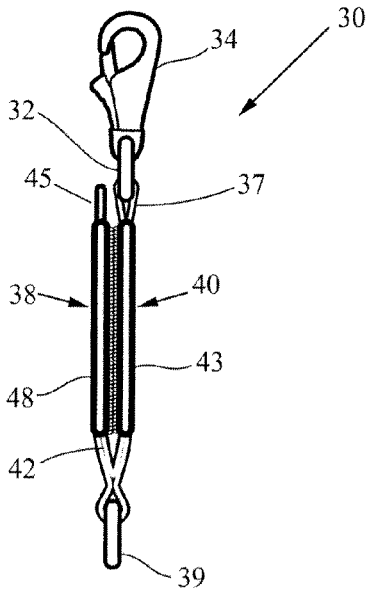
FIG. 8 is a side view of the holder of FIG. 5 shown with the snap hook rotated ninety degrees.

The two halves or members 38, 40 may be moved from a closed position (FIGS. 5 and 8) in which the two members 38, 40 are folded and held together with the hook and loop type fastening material disposed on their respective attachment panels 44, 46, to an open position (FIGS. 6 and 7) wherein the two members 38, 40 are unfolded and held together only by the flexible hinge strap 42.

As shown in FIG. 9, the flexible strap 37, hinge strap 42 and pull tab 45 may be formed from a single integral strap of flexible material (such as nylon). The single strap has a first end 64 secured between the second attachment panel 44 and the decorative panel 43 of the upper member 40, a first section extending from the first end 64 and looped around the straight section of the D-shaped ring 32, a second section extending from the first section between the second attachment panel 44 and decorative panel 43 of the upper member 40, through the second ring 39 and between the first attachment panel 46 and decorative panel 48 of the lower member 38, a third section extending beyond the lower member 38 to form the pull tab 45, and a second end 66 secured between the second attachment panel 44 and decorative panel 43 of the upper member 40.

Alternatively the second end 66 may be secured between the first attachment panel 46 and decorative panel 48 of the lower member 38.

Figure 10:
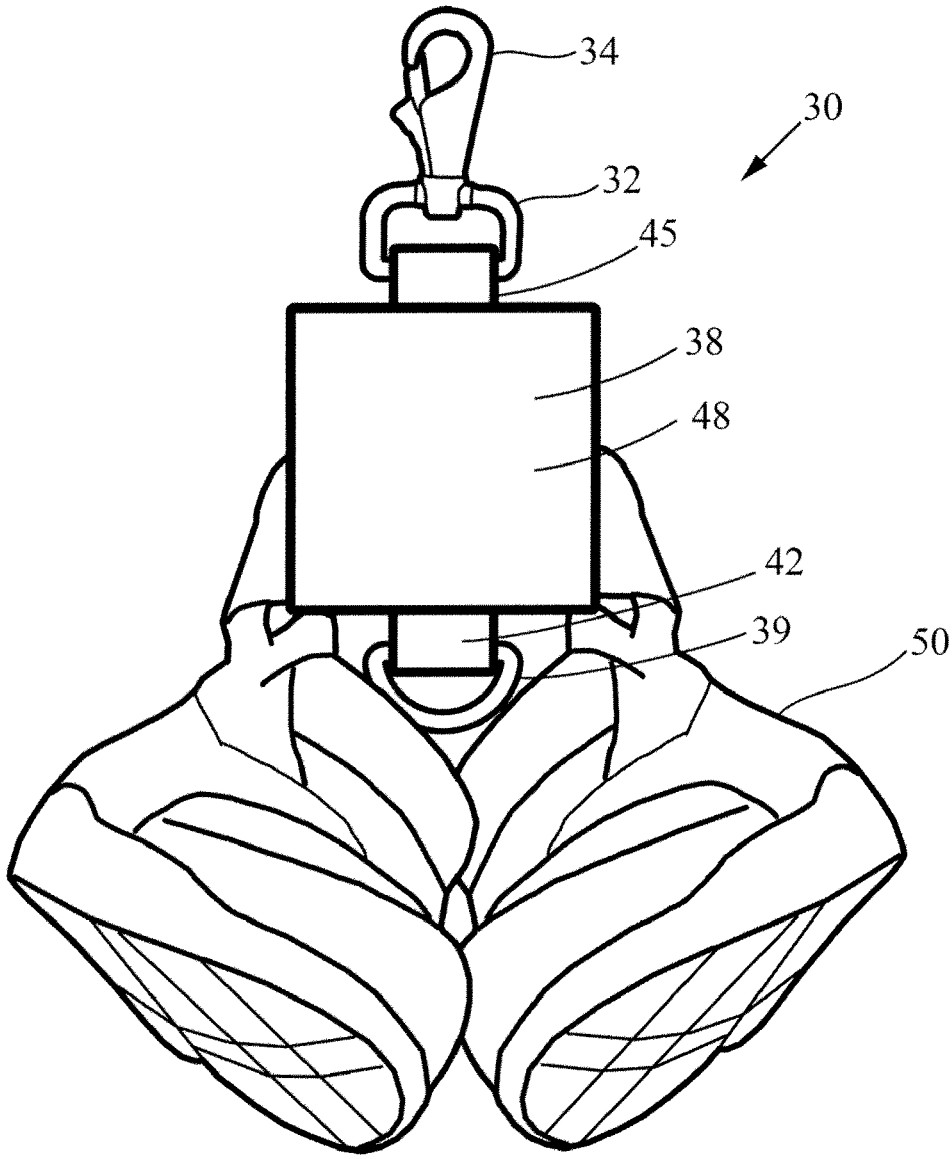
FIG. 10 is a front plan view of the holder of FIG. 5 shown holding a pair of shoes.
Figure 11:
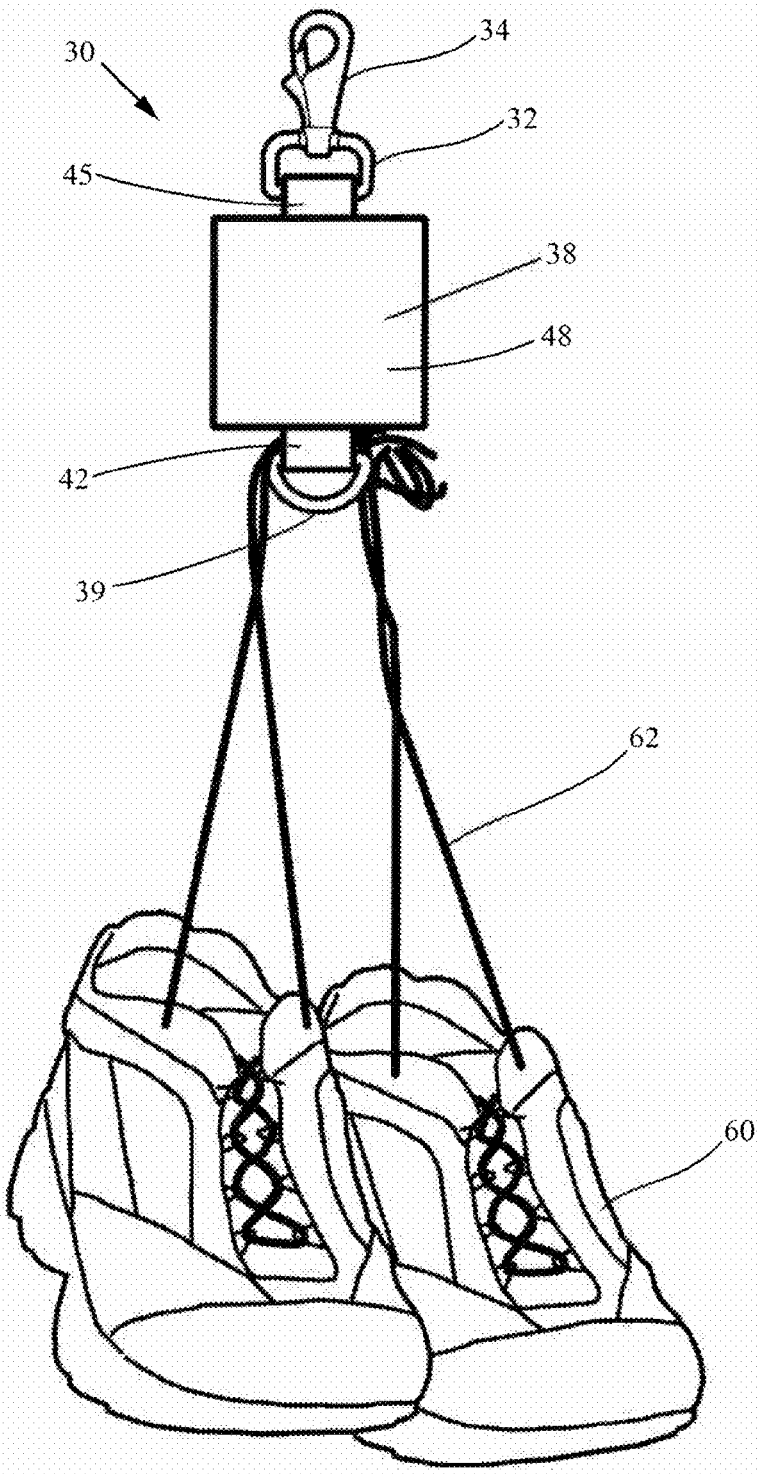
FIG. 11 is a front view of the holder of FIG. 5 shown holding a pair of shoes by their laces.
Figure 12:
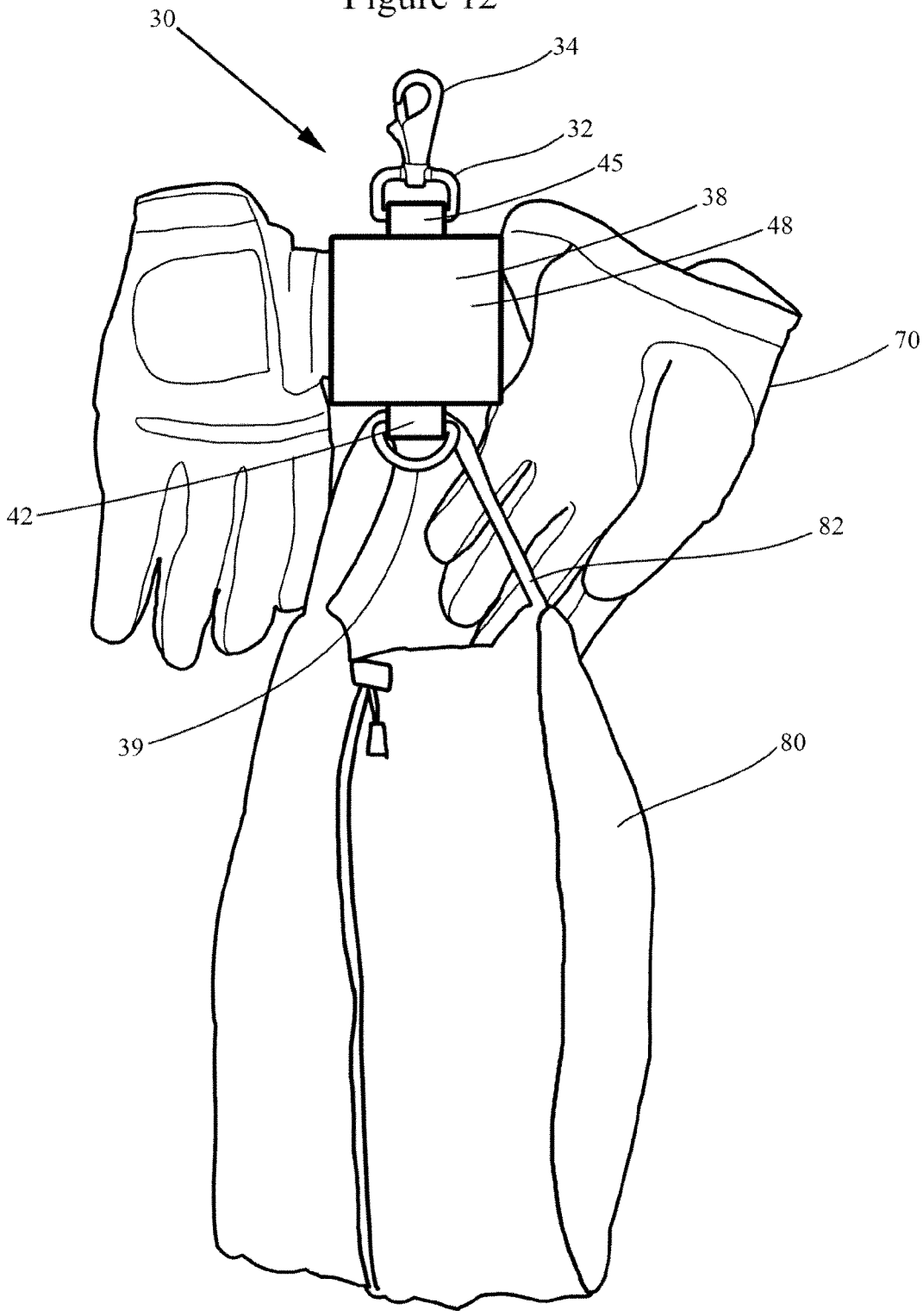
FIG. 12 is a front perspective view of the holder of FIG. 5 shown holding a pair of gloves and a small bag.

To use the holder 30 the holder 30 is opened as shown in FIG. 6 and then articles can be attached to one or both attachment panels 44, 46. Additional articles can be suspended from the hinge strap 42 as shown in FIGS. 10-12. Still more articles (not shown) may be attached to the second ring 39.

EXAMPLES

In the following examples the invention is described as a holder for shoes, gloves and bags, although it should be understood that the invention can be used to hold any suitable article or articles. It should also be understood that the terms "hook type fastening material" and "loop type fastening material" may be used interchangeably.

FIG. 10 is a front perspective view of a clamshell type holder 30 shown holding a pair of shoes 50. The shoes 50 have a surface featuring hook or loop type fasteners that can be secured to one or both of the members 38, 40 via the hook and loop type fastening system when the two members 38, 40 are in the open position. The holder 30 can be secured via the snap-hook fastener 34 to a gym bag, wall hook or other article.

FIG. 11 illustrates how the holder 30 can be used to hold items that do not have a hook or loop type fastener surface. In the figure a holder 30 is holding a pair of shoes 60 by their laces 62. The laces 62 preferably are tied together, then draped over the strap 42 before the two members 38, 40 are folded and secured together.

FIG. 12 illustrates how the clamshell holder 30 can be used to hold multiple items. In FIG. 12 the holder 30 is shown holding a pair of gloves 70 and a small bag 80. The gloves 70 have a surface having loop or hook type fasteners that can be secured to one member 38, 40 of the holder 30. The small bag has a strap or handle 82 which is draped over the holder strap 42 before the two holder halves 38, 40 are folded and secured together.

Third Embodiment: Clamshell With Removable Decorative Panels

FIGS. 13-21 illustrate a third embodiment of the present invention, one that is similar to the second (clamshell) embodiment except that the decorative panels are removable. When the decorative panels are removed additional attachment surfaces are exposed. As in the second embodiment the holder 130 comprises a metal or plastic D-shaped ring 32, a snap-hook type fastener 34 attached to the ring 32 in swivel fashion, and a clamshell tag 136 suspended from the ring 32 by a flexible strap 37. Also as in the first two embodiments the flexible strap 37 may be a loop of material that is looped around the straight section of the D-shaped ring 32 with both ends sewn into or otherwise secured to the clamshell tag 136.

Figure 21:
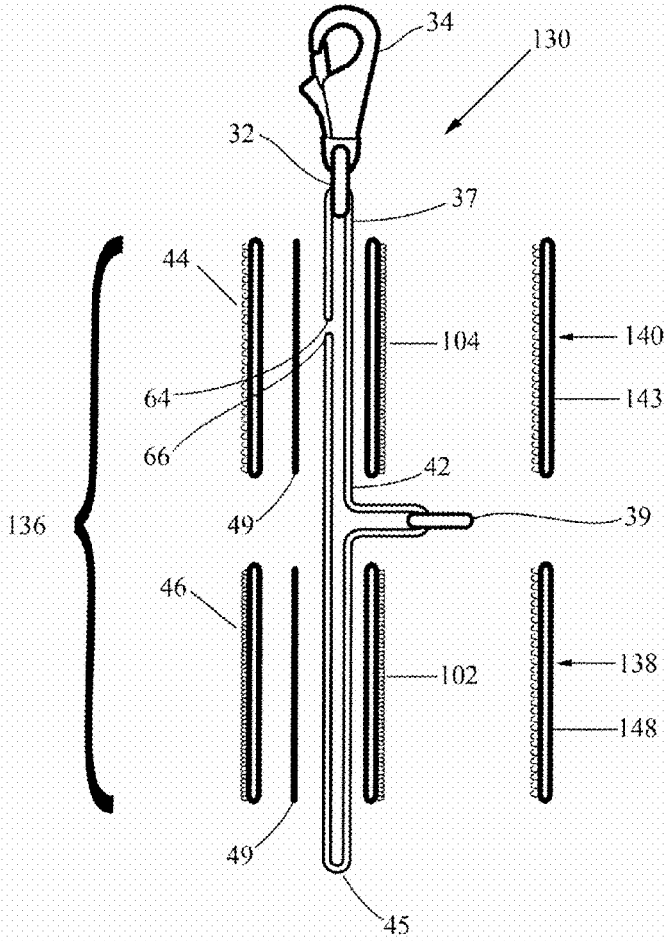
FIG. 21 is an exploded view of the holder of FIG. 20, shown in the unfolded position.

As best shown in FIG. 21, the lower member 138 comprises an additional, or middle, attachment panel 102 not present in the second embodiment. The middle attachment panel 102 is substantially co-extensive with and interposed between a first attachment panel 46 and a decorative panel 148. The first attachment panel 46 and the middle attachment panel 102 are affixed to either side of an inner layer of stiffening material 49. The first attachment panel 46 comprises a layer of hook or loop type fastening material disposed on an inner facing side (the side facing the upper member 140 when the holder 130 is in the folded position). The middle attachment panel 102 comprises a layer of hook or loop type fastening material on an outer facing side (away from the first attachment panel 46). The decorative panel 148 preferably has a decorative element disposed on its outer facing side and, unlike the second embodiment, a layer of hook or loop type fastening material disposed on the inner side facing the middle attachment panel 102. In this way the decorative panel 148 can be removably affixed to the middle attachment panel 102 to expose an additional surface for attaching articles. A pull tab 45 may be affixed to the perimeter of the lower member 138 away from the hinge strap 42. As in the second embodiment, an optional second ring 39 may be secured to the hinge strap 42.

The upper member 140 (closest to the snap hook 34) also comprises an additional, middle attachment panel 104. The middle attachment panel 104 is interposed between a second attachment panel 44 and a decorative panel 143. The second attachment panel 44 and the middle attachment panel 104 are affixed to either side of an inner layer of stiffening material 49. The second attachment panel 44 comprises a layer of hook or loop type fastening material disposed on an inner facing side (the side facing the lower member 138 when the holder 130 is in the folded position). The middle attachment panel 104 also comprises a layer of hook or loop type fastening material on an outer facing side (away from the first attachment panel). The decorative panel 143 has a decorative element disposed on its outer facing side and a layer of hook or loop type fastening material disposed on the inner side facing the middle attachment panel 104. In this way the decorative panel 143 can be removably affixed to the middle attachment panel 104 to expose an still more fastening surface for attaching articles.

The two halves or members 138, 140 may be moved from a closed position (FIGS. 13 and 20) in which the two members 138, 140 are folded and held together with the hook and loop type fastening material disposed on their respective attachment panels 44, 46, to an open position (FIGS. 15 and 16) wherein the two members 138, 140 are unfolded and held together only by the flexible strap 42.

As in the second embodiment, and referring to FIG. 21, the flexible strap 37, hinge strap 42 and pull tab 45 may be formed from a single integral strap of flexible material (such as nylon). The single strap has a first end 64 secured between the second and middle attachment panels 44, 104 of the upper member 140, a first section extending from the first end 64 and looped around the straight section of the D-shaped ring 32 to form the flexible strap 37, a second section extending from the first section between the second and middle attachment panels 44, 104 of the upper member 140, through the second ring 39 and between the first and middle attachment panels 46, 102 of the lower member 138, a third section extending beyond the lower member 138 to form the pull tab 45, and a second end 66 secured between the second and middle attachment panels 44, 104 of the upper member 140. Alternatively, the second end 66 may be secured between the first and middle attachment panels 46, 102 of the lower member 138.

Figure 13:
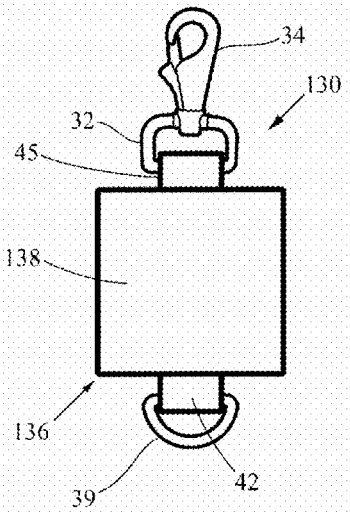
FIG. 13 is a front plan view of a third embodiment of a holder according to the present invention, shown in the folded position.
Figure 14:
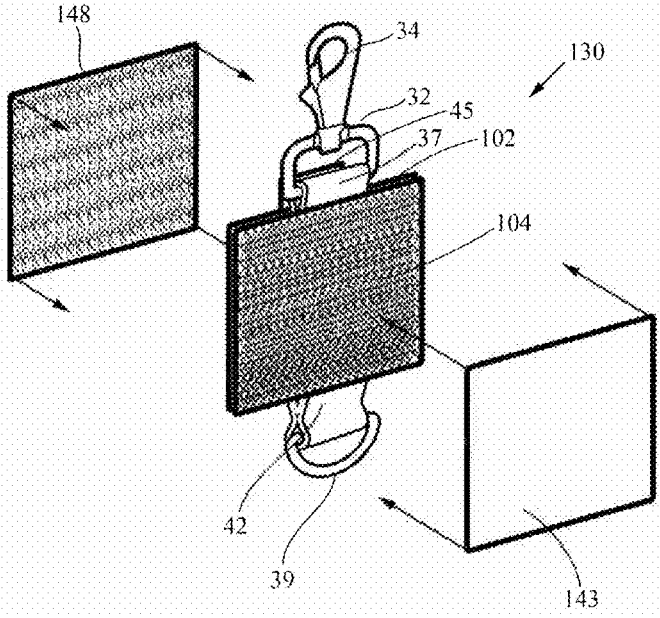
FIG. 14 is an exploded view of the holder of FIG. 13.

FIG. 14 is an exploded view of the holder of FIG. 13, showing how decorative panels 143, 148 may be removably secured to the middle attachment panels 104, 102.

Figure 15:
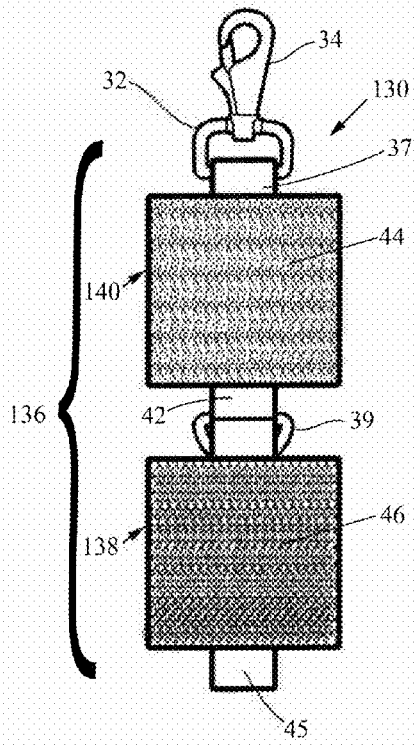
FIG. 15 is a front plan view of the holder of FIG. 13 shown in the unfolded position.
Figure 16:
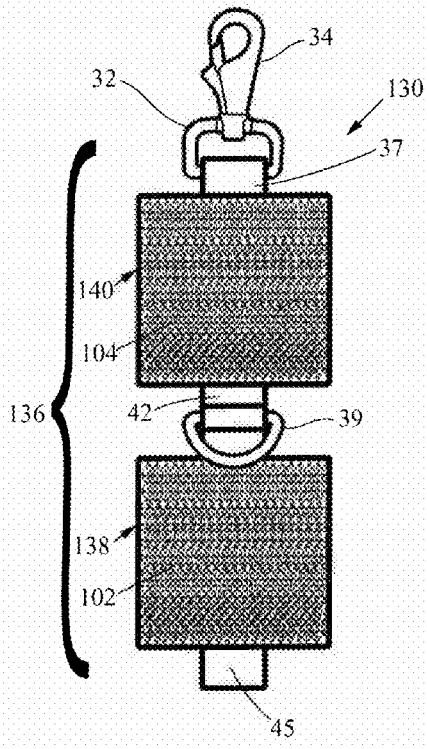
FIG. 16 is a rear plan view of the holder of FIG. 15 shown with the snap hook rotated 180 degrees and with the two decorative panels removed.
Figure 17:
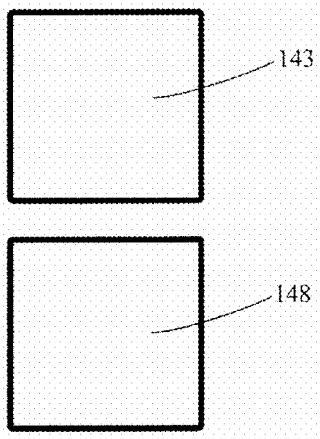
FIG. 17 is a front plan view of the two decorative panels removed from the holder of FIG. 16, showing their decorative sides.
Figure 18:
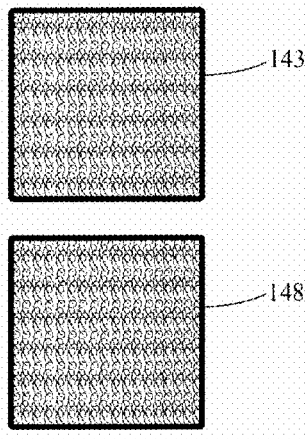
FIG. 18 is a rear plan view of the two decorative panels removed from the holder of FIG. 16, showing their attachment sides covered with hook or loop type fastening material.

FIGS. 15 and 16 are front and rear plan views respectively of the holder 130 of FIG. 13, shown in the unfolded position. In these views it can be seen that the clamshell tag 136 comprises lower and upper members 138, 140 hingedly attached to each other via a flexible hinge strap 42. The hinge strap is sewn into or otherwise attached to each half 138, 140 of the clamshell tag 136. In FIG. 16 the decorative panels 143, 148 have been removed to expose the middle attachment panels 104, 102. The outer and inner facing sides of the decorative panels 143, 148 are shown in FIGS. 17 and 18 respectively.

Figure 19:
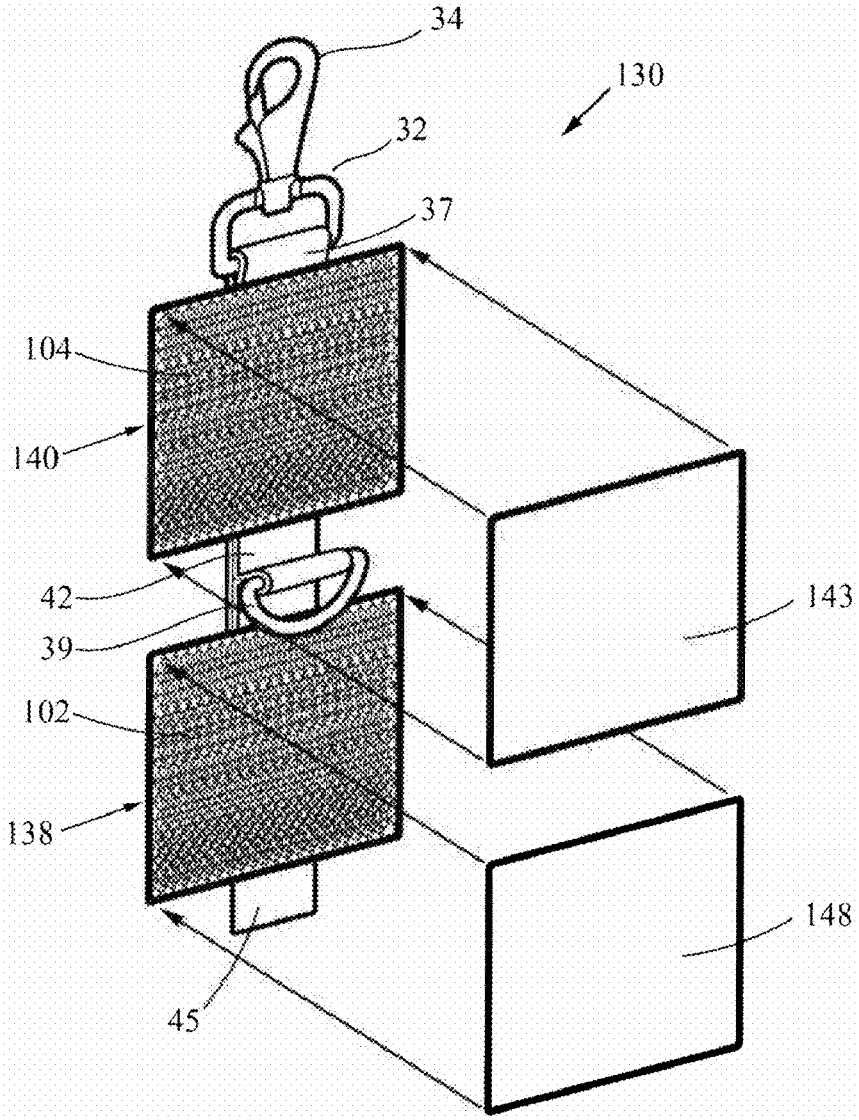
FIG. 19 is a perspective view of the holder of FIG. 15 shown with the two decoration panels.
Figure 20:
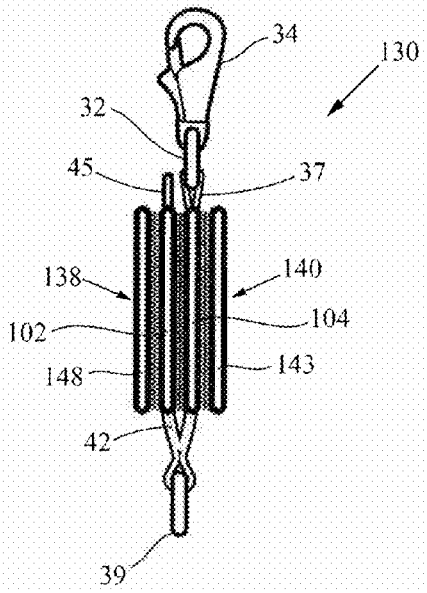
FIG. 20 is a side view of the holder of FIG. 15 shown in the folded position with the front and rear decorative panels attached.

FIG. 19 is a perspective view of the holder 130 of FIG. 16 showing how the two decoration panels 143, 148 can overlay the middle attachment panels 104, 102 respectively. FIG. 20 is a side view of the holder 130 shown in the folded position with the decorative panels 143, 148 attached.

Fourth Embodiment

Figure 22:
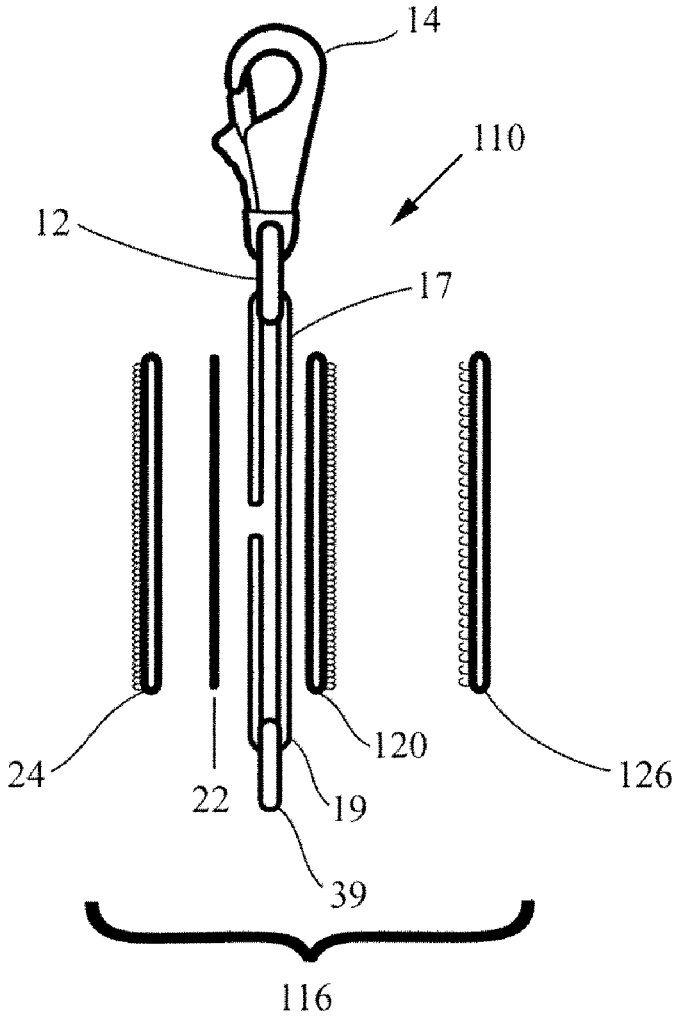
FIG. 22 is a side exploded view of a fourth embodiment of a holder according to the present invention.

As shown in FIG. 22, still another embodiment 110 is anticipated which is similar to the first embodiment shown in FIGS. 1-4, except that the hang tag 116 includes a middle attachment panel 120 interposed between the attachment panel 24 and the decorative panel 126 so that the decorative panel 126 can be removed to expose another fastening surface on the middle attachment panel 120. The decorative panel 126 includes an inner facing side (the side facing the second attachment panel 120) having a layer of fastening material. As with the first embodiment, an optional second ring 39 may be secured to the lower edge of the hang tag 116 by a flexible loop 19.

It is understood that the embodiments of the invention described above are only particular examples which serve to illustrate the principles of the invention. For example, the holder could also be used to hold an article having a hook, wherein the hook is hooked over the hinge strap 42. Modifications and alternative embodiments of the invention are contemplated which do not depart from the scope of the invention as defined by the foregoing teachings and appended claims. It is intended that the claims cover all such modifications and alternative embodiments that fall within their scope.

I claim:

1. A holder for holding one or more articles, the holder comprising:

a ring;

a fastener attached to the ring in swivel fashion;

a clamshell tag; and a strap for connecting the clamshell tag to the ring;

the clamshell tag comprising first and second members hingedly attached to each other via a flexible hinge;

said first member comprising a first attachment panel, a first middle attachment panel and a first decorative panel, the first middle attachment panel being substantially co-extensive with and interposed between the first attachment panel and the first decorative panel, the first middle attachment panel comprising a layer of hook or loop type fastening material disposed on an outer facing side away from the first attachment panel, the first attachment panel comprising a layer of hook or loop type fastening material disposed on an inner facing side away from the first middle attachment panel, the first decorative panel being removably affixed to the outer facing aside of the first middle attachment panel;

said second member comprising a second attachment panel, a second middle attachment panel and a second decorative panel, the second middle attachment panel being substantially co-extensive with and interposed between the second attachment panel and the second decorative panel, the second middle attachment panel comprising a layer of hook or loop type fastening material disposed on an outer facing side away from the second attachment panel, the second attachment panel comprising a layer of hook or loop type fastening material disposed on an inner facing side away from the second middle attachment panel, the second decorative panel being removably affixed to the outer facing aside of the second middle attachment panel;

wherein the first and second members may be moved from a closed position in which the two members are folded and held together via the hook and loop type fastening materials, to an open position wherein the two members are unfolded and held together only by the flexible hinge.

2. The holder of claim 1 wherein one or both of the decorative panels has a decorative element disposed on its outer facing side away from the attachment panels.

3. The holder of claim 1 wherein each of the first and second members further comprises an inner web of stiffening material interposed between the attachment and middle attachment panels.

4. The holder of claim 1 wherein the fastener is a snap-hook fastener, the holder further comprising a second ring secured to the flexible hinge.

* * * * *